United States Patent [19]

Corluy et al.

[11] 4,081,280

[45] Mar. 28, 1978

[54] PROCESSING OF PHOTOGRAPHIC SILVER HALIDE MATERIALS

[75] Inventors: Hans Josephus Corluy, Berchem; François Leon Schelfaut, St. Niklaas; Pierre Herman Nys, Berchem; Raoul Jan Börtels, Lier, all of Belgium

[73] Assignee: AGFA-GEVAERT N.V., Mortsel, Belgium

[21] Appl. No.: 661,816

[22] Filed: Feb. 26, 1976

[30] Foreign Application Priority Data

Feb. 27, 1975 United Kingdom ..... 8307/75

[51] Int. Cl.[2] ..... G03C 5/26; G03C 5/24; G03C 5/30

[52] U.S. Cl. ..... 96/50 A; 96/63; 96/66 R; 96/66.3

[58] Field of Search ..... 96/50 A, 66, 63, 66.3, 96/66.4, 66.5

[56] References Cited

FOREIGN PATENT DOCUMENTS

| | | | |
|---|---|---|---|
| 2,004,893 | 8/1971 | Germany | 96/50 A |
| 2,343,242 | 3/1974 | Germany | 96/50 A |
| 1,313,796 | 4/1973 | United Kingdom | 96/50 A |

OTHER PUBLICATIONS

Journal of Photo. Science, vol. 12, 1964, pp. 61–70.
Handbook of Photography, 1940, pp. 368–369.
Mason, Processing Chemistry, 1966, pp. 136–139, 147–151.
Photo Lab Index, 1971, 3–201, 202, 204.07–204.12, 215–216.

*Primary Examiner*—Mary F. Kelley
*Attorney, Agent, or Firm*—William J. Daniel

[57] ABSTRACT

A process for developing photographic silver halide lith-materials in an automatic processing machine with a lith-developer, wherein two replenishers are used, one for compensation of the developer exhaustion resulting from aerial oxidation and a second replenisher serving for the compensation of exhaustion by development.

17 Claims, No Drawings

PROCESSING OF PHOTOGRAPHIC SILVER HALIDE MATERIALS

The present invention relates to a method for developing photographic silver halide materials under substantially the same developing conditions.

Reproducible development conditions are a need in standardized machine processing. Especially in the graphic arts where the development of the exposed silver halide materials proceeds more and more automatically and substantially identical sensitometric characteristics of the images are required, constant development activity is of particular importance.

A major part of the graphic art images are halftone images, which are formed in high-contrast type silver halide materials with high-contrast developers i.e. the so-called lith-developers. In order to obtain very high-contrast screen dots in half tone images it has been practice to formulate developers from essentially a p-dihydroxybenzene such as hydroquinone, an alkali, an alkali metal bromide and a low level of free sulphite ions. The low level of sulphite ions partially stabilizes the developer solution for a short period of time and is achieved in most commercial developers of this type by the use of an aldehyde sulphite such as sodium formaldehyde hydrogen sulphite, which acts as a sulphite ion buffer. Such developer has been described, e.g., in the United Kingdom Pat. No. 1,197,306.

Recently developed high contrast-developers being lith-developers that have a relatively high sulphite ion content have been described in the United Kingdom patent specifiation No. 1,376,600.

Very high contrast results, preferably with gamma above 10, also called "lith-gradation," can be obtained with said high-contrast developers and the so-called "lith-silver halide emulsion materials." In these materials the silver halide comprises at least 50 mole % of chloride, the balance, if any, being bromide and optionally a minor amount of iodide. The relationship of lith-gradation and sharpness of a dot is discussed in the handbook of Modern Halftone Photography of E. Fred Noemer — published by Perfect Graphic Arts Demarest, N.N. — U.S.A. (1965) pages 54–55.

As is generally known, the composition of a developer solution used in silver halide photography changes because of the chemical reaction taking place during development and by contact with the oxygen of the air. These chemical changes have a certain influence on the photographic characteristics of the finally obtained images.

In the development of the exposed silver halide emulsion a certain quantity of the developing compounds and of the oxidation-inhibiting compounds is used up and halide ions of the developed silver halide enter the developing solution.

How fast the exhaustion of the developer proceeds herein is a question of the number and kind (negative or positive material), and content of developable (exposed or fogged) silver halide in the material processed.

Furthermore, each piece of developed silver halide material leaving the development carries away a certain amount of developer liquid, which amount is lost for the subsequent development of material. This quantity depends on the thickness and kind of the silver halide emulsion layer, the type of support, the surface of the material, and the period of time during which the film was allowed to drip or to be squeezed to remove the surplus developer solution.

The continuous contact of the developing solution with the oxygen of the air also consumes an amount of the developing agents together with an amount of the oxidation-inhibiting compounds and in this way changes the reducing capacity of the developer. The longer the contact time, the larger the area of contact between the developing liquid and the air and the more intense the agitation of the developing liquid, the more rapidly oxidation will take place. Aerial oxidation is also influenced by the temperature of the developing solution, i.e., the higher the temperature, the more intense the aerial oxidation proceeds.

In order to keep the development characteristics at an approximately constant level, different methods are applied. The most common methods are the following:

a. frequently discarding the used developer solution and replacing it by fresh solution and
b. from time to time partly replacing the developer solution with a so-called replenisher.

With tray development the only practical method is the first one, which of course involves a high consumption of developer and as a consequence proves costly.

In the case of machine processing it is certainly more economical to keep the development activity at the desired level by replacing at the proper time a part of the developer by a replenisher.

As the replenishing concept is practical nowadays, the action of aerial oxidation is not taken into account efficiently and replenishment is carried out with only one solution whose composition is characteristic for a well defined amount and kind of film proceeded. In other words, the amount of introduced replenisher is substantially only proportional to the amount of developed silver halide. Especially in lith-developers aerial oxidation is by no means negligible and one has to remedy for the changes in photographic results brought about thereby.

in the United Kingdom Pat. No. 1,313,796 a method has been described for obtaining substantially constant developer activity under any regime of the film throughput. In this method, based on the replenishment of a photographic silver halide developer solution, first and second replenisher solutions having different halide ion concentrations are used. The solutions are added to the developer such that both the halide ion concentration and the concentration of unoxidized developing agent of the developer are maintained substantially at a desired level.

The first replenisher solution has a low halide ion concentration, preferably but not necessarily zero, whereas the second replenisher solution contains a higher concentration of halide ions, which is substantially equal to the desired concentration in the developer bath.

However, the compensation for the change in halide ion concentration and in the concentration of unoxidized developing agent only partly solves the problem of keeping the development characteristics in lith-development substantially constant. Thus, e.g., sulphite ion concentration, pH and even the concentration of the reaction products are also important and have to be kept under careful control.

It is an object of the present invention to provide a development process in which the developing characteristics of the developer are kept very constant by controlled replenishment with two separate replenisher solutions.

It is a further object of the present invention to provide a developing process in which the developer already from the introduction of the first silver halide photographic material to be developed yields photographic characteristics that are obtained under running work load conditions.

It is another object of the present invention to provide a development process including a photographic check for the controlled introduction of two replenisher solutions.

The present invention provides a process for developing photographic silver halide materials, which process comprises the steps of:

developing latent halftone images in photographic silver halide lith materials in an automatic processing machine with a lith-developer containing:

a p-dihydroxybenzene developing compound, free sulphite ions, an alkali metal bromide, said developer containing per liter no more than 0.05 g of any auxiliary developing compound(s) that show(s) superadditive developing effect with said p-dihydroxybenzene developing compound, adding to the developer two replenisher solutions called $R_D$ and $R_A$ respectively and being different in the following aspects:

1. the pH of $R_D$ is higher than the pH of $R_A$,
2. the halide ion concentration of $R_D$, which may be zero, is smaller than the halide concentration of $R_A$,
3. the p-dihydroxybenzene developing compound concentration of $R_D$ is different from the p-dihydroxybenzene developing compound concentration of $R_A$,
4. the free sulphite ion concentration of $R_D$ is different from and preferably lower than the free sulphite ion concentration of $R_A$; the difference mentioned under (3) and (4) being such that the ratio by weight of the p-dihydroxybenzene developing compound to free sulphite ions in the replenisher $R_D$ is different from the corresponding ratio by weight in replenisher $R_A$, said adding being controlled through the results of (a) check(s) on the performance of the actual i.e., momentary developer with respect to a lith silver halide emulsion material that has been exposed through (a) sensitometric wedge(s) and subjected to development in the actual developer to produce a halftone wedge print whereon the distance between area of different dot values, e.g., 10 and 95 % dot value, is read and compared with a reference distance, the deviation of said reference distance serving for guidance in determining a partial replacement of developer by replenisher $R_A$, and the location of a sensitivity point on said halftone wedge print or on a continuous tone wedge print on said material with respect to a reference sensitivity point serving for guidance in determining the partial replacement of developer by replenisher $R_D$.

The formulation of the replenisher $R_D$ is such that it mainly compensates in the developer for exhaustion by the chemical reactions proceeding during development.

The formulation of the replenisher $R_A$ is such that it mainly compensates in the developer for exhaustion by aerial oxidation.

According to a first modified embodiment of the present invention two replenishers are used, one of which is composed of a mixture of $R_D$ and $R_A$ wherein the amount of $R_A$ in the current work load conditions is still insufficient for complete compensation of the developer exhaustion resulting from aerial oxidation. As second replenisher minor amounts of separately stored $R_A$ are introduced serving for the balance in the compensation of exhaustion by oxidation.

The mixture of $R_D$ and $R_A$ after the already mentioned check is added proportionally to the developable silver halide quantity of film put through the developer and any deviation of the reference distance detected by further checks of the actual developer composition is adjusted by amounts of $R_A$ that mainly compensate for the exhaustion by aerial oxidation.

According to a second modified embodiment of the present invention the replenisher solution $R_A$ is used in two parts, one part $R_{A1}$ having a larger amount of sulphite ions than the $R_A$ replenisher and so mainly compensating for the loss of sulphite ions, the other part $R_{A2}$ having a larger content of developing agent than the $R_A$ replenisher, and so mainly compensating for the loss of developing compound(s). An even better adjustable compensation for exhaustion and more reproducible developing results are obtained therewith. This is also the case when a mixture of $R_D$ and $R_A$ is used as in the first modified embodiment but in two parts then, one part containing a larger amount of sulphite ions than the other part, which in its turn contains a larger amount of developing agent.

When the actual ratio of the exhaustion by development to that by aerial oxidation is known the two replenisher solutions $R_D$ and $R_A$ may be added as a mixture in a proper ratio before entering the developer.

According to a special embodiment and in order to obtain already from the introducing of the first silver halide materials photographic results that are substantially identical to those obtained under running work load conditions one or more reaction products formed during lith-development and/or contact with oxygen of the air are introduced in the developer from the very beginning of the automatic development processing.

It has been established experimentally that at least one of said reaction products viz, p-dihydroxybenzene sulphonate has an influence on the photographic characteristics and normally gives rise to an increase in sensitivity. Since the formation of p-dihydroxybenzene sulphonate is a continuously progressing process the above defined replenisher solutions contain no or less p-dihydroxybenzene sulphonate than the developer in use in order to keep the concentration of p-dihydroxybenzene sulphonate and its influence on the photographic properties at the desired level.

When the lith-developer contains free sulphite ions in an amount large enough to prevent high-contrast development certain substances such as nitro-indazole or nitrobenzimidazole compounds as described in the United Kingdom Pat. No. 1,376,600 are added. In the presence of these compounds, among which 5-nitroindazole is preferred, the free sulphite ion content may be more than 5 g per liter without destroying the lith-gradation.

When a lith-developer of high free sulphite content is used, said nitro compounds are incorporated in the developer and preferably also in the replenishers. Details about suitable amounts have been described in the United Kingdom Pat. No. 1,376,600.

In the method of the present invention the lith-developer and at least one of the replenishers may contain all kinds of additives that improve the quality of the halftone print. Examples of such additives are polymeric oxyalkylene compounds and poly-N-vinylpyrrolidone and derivatives described in said United Kingdom Pat. No. 1,376,600 and U.S. Pat. No. 3,617,284. A preferably used polyoxyalkylene compound is polyoxyethylene glycol having an average molecular weight of at least 1500.

In carrying out the already mentioned checks identically exposed strips of lith-materials are put through the developer at desired time intervals or continuously.

Accordingly to a preferred embodiment the exposure of said strips is carried out in such a way that a screened (halftone) wedge print and a continuous wedge print are produced. Parallel with each wedge a millimeter scale is printed. The "zero" value of the millimeter scale print corresponds with the maximum density value of each wedge print. In the region of the lower exposures each strip has a notch indicating the part of the strip that has to be introduced first in the developing machine in order to ensure comparable readings.

The strips can be factory pre-exposed or exposed through the described wedges at the spot. Here the exposure is preferably effected at the very moment before development or some time earlier. The strips may be exposed on a separate film material or on the film used for production work.

The sensitivity point is determined either on the continuous tone wedge print, preferably at an optical density between 0.3 and 3.0, or on the halftone wedge at any % dot value, preferably, however, between 10 and 95 % dot value. The sensitivity point is transferred perpendicularly onto said millimeter scale.

To find the 10% dot value place, the screened wedge print is measured with a densitometer having a reading spot (aperture) covering at least 15 dots (see the already mentioned handbook of Modern Halftone Photography by Ewald Fred Noemer — pages 97–98). The integrated halfton density (D integral) corresponding with 10% dot area is 0.04 + fog level of the film.

The D integral point corresponding with said 10% dot area is transferred perpendicularly to the millimeter scale and called $D_1$.

The integrated halftone density (D integral) corresponding with 95% dot area is 1.30 + fog level of the film. The D integral point corresponding with said 95% dot area is transferred perpendicularly to the millimeter scale and called $D_2$. The distance between $D_1$ and $D_2$ is called here "integrated density range."

Development exhaustion of the lith-developer causes a shift of the sensitivity with respect to the sensitivity reference point to the lower values.

Addition of an amount of $R_D$ or the mixture $R_D + R_A$ to the developing solution causes a shift of the sensitivity point with respect to the sensitivity reference point to the higher values over a distance depending on the amount of developer replaced by replenisher and the concentration of the solution(s) used.

Consequently, when a shift of the sensitivity point to the lower sensitivity values with respect to the reference sensitivity point is observed by one or a plurality of said checks, the rate of partial replacement of the developer by replenisher $R_D$ or the mixture of $R_D$ and $R_A$ is increased and/or an extra amount of $R_D$ or of said mixture is added.

When a shift of the sensitivity point to the higher sensitivity values with respect to the reference sensitivity point is observed by one or a plurality of said checks, the rate of partial replacement of the developer by replenisher $R_D$ or the mixture of $R_D$ and $R_A$ is diminished and/or silver halide material to be developed is put through the developer without replenishment with $R_D$ or said mixture.

The "integrated density range," i.e., the distance between $D_1$ and $D_2$ becomes smaller by exhaustion due to aerial oxidation. The addition of replenisher $R_A$ remedies for this unwanted effect.

Consequently when a decrease of said distance is detected either by one or a plurality of said checks, an amount of $R_A$ partially replacing the developer is introduced in the developer and/or the rate of partial replacement of the developer by replenisher $R_A$ or the amount of $R_A$ in the mixture $R_D+R_A$ is increased.

When an increase of said distance is detected by one or a plurality of said checks, the rate of partial replacement of the developer by replenisher $R_A$ or the amount of $R_A$ in the mixture $R_D+R_A$ is diminished.

According to a preferred embodiment of the process of the present invention $R_D$ is introduced in the developer to substitute a part of it at a rate controlled by an estimated amount of silver halide to be develoed and by the detected results of a plurality of said checks.

The introduction of $R_A$ proceeds preferably as a function of time and a tendency of enlargement of the integrated density range detected by a plurality of said checks is counteracted by decreasing the rate of replacing the developer by $R_A$. A tendency of reduction of the integrated density range detected by a plurality of said checks is counteracted by increasing the rate of replacing developer by $R_A$.

The invention will now further be illustrated by a specific example without, however, having it limited thereto.

EXAMPLE

A lith-type silver halide film having a silver halide coverage equivalent to 8 g of silver nitrate per sq.m. and containing a silver chlorobromide emulsion with 84 % by weight of chloride and 16 % by weight of bromide was used in the production of halftone prints and processed in a PAKONOLITH 24 processor (Pakonolith is a trade name of Pako Corporation, Minneapolis, U.S.A. for a halftone film processor).

The developer introduced in said processor was obtained by mixing the following ingredients:

| | | |
|---|---|---|
| formaldehyde hydrogen sulphite | 50 | g |
| potassium metabisulphite | 4.25 | g |
| potassium bromide | 2 | g |
| potassium chloride | 6 | g |
| hydroquinone | 15 | g |
| potassium carbonate | 70 | g |
| boric acid | 6 | g |
| polyoxyethylene glycol (average molecular weight 1500) | 0.3 | g |
| hydroquinone sulphonic acid | 15 | g |
| water to make | 1 | liter. |

The pH was adjusted with potassium hydroxide to 9.90.

The replenisher solution $R_A$ had a composition identical to that of the developer solution except for the use of:

| | | |
|---|---|---|
| potassium metabisulphite | 9.25 | g |
| hydroquinone | 21 | g |
| hydroquinone sulphonic acid | | none |

The pH was adjusted by means of potassium hydroxide to 9.81.

The replenisher solution $R_D$ had a composition identical to that of the developer solution except for the use of:

| | | |
|---|---|---|
| potassium metabisulphite | 7.15 | g |
| hydroquinone | 19 | g |
| potassium bromide | 0.7 | g |
| potassium chloride | | none |
| hydroquinone sulphonic acid | 7 | g |

The pH was adjusted with potassium hydroxide to 10.05.

The development time applied in the present processing was 1 min 45 s. The development temperature was kept constant at 26° C.

Replenishment of the developer solution proceeded at the following rates with the replenishers $R_D$ and $R_A$.

320 ml of $R_D$ were added per sq.m of said film, which was exposed in such conditions that about 50 % by weight of the silver halide was developable; 5500 ml of $R_A$ per 24 h in small equal portions every 20 minutes.

Every 2 h a test strip of the above film being exposed in contact with a continuous tone wedge with an increment of d = 0.15 per cm and exposed through a magenta contact screen type MP of 60 lines per cm marketed by the applicant is developed in the momentary developer.

According to the applied check method the "sensitivity reference point" at a density 0.04 above fog level corresponds with the point on the millimeter scale below the 0.04 density value on the continuous tone wedge print of a correct developed strip.

The "reference integrated density range" is read on the millimeter scale below the halftone wedge and is the distance on said scale that corresponds with the distance between the integrated density 0.04 above fog level and the integrated density 1.30 above fog level on said halftone wedge. The sensitivity reference point and reference integrated density range are determined with a developer having the desired activity, viz, the activity of the fresh developer described above.

For the replenishment operation the following procedure was followed: no changes in either of the above identified replenisher additions ($R_D$ and $R_A$) were applied as long as on three successive control strips (obtained with intervals of 120 min) no deviation greater than 2 mm from the reference sensitivity point and from the integrated density range in the same sense was observed. When a larger deviation was detected the above replenishment rates were diminished or increased in the following way.

After the detection of a tendency to surpass said 2 mm shift in the direction of increased sensitivity, the addition rate of $R_D$ is decreased with 10%. An increase of 10% of the $R_D$ rate is applied for counteracting a tendency in the opposite direction.

A tendency to produce an integrated density range enlargement of more than 2 mm is counteracted by decreasing in the above development circumstances the $R_A$ replenishment rate with 10%. An increase of 10% of the $R_A$ rate is applied for counteracting the reverse tendency, viz, of decreasing integrated density range.

The photographic sensitivity, the dot sharpness and bromide drag remained practically unchanged for weeks in carrying out the machine development under the described circumstances.

We claim:

1. A process for developing photographic silver halide materials comprising the steps of:

developing latent halftone images in a succession of photographic silver halide emulsion lith-materials in an automatic processing machine with a lith-developer solution consisting essentially of:

hydroquinone developer, a source of free sulphite ions, an alkali metal bromide, and an alkaline compound in sufficient amount to render said solution basic, said developer containing per liter no more than 0.05 g of any auxiliary developing compound(s) that show(s) super-additive developing effect with said hydroquinone, periodically during such development checking the performance of said developer solution by developing therein a test sample of the same lith emulsion material being processed which sample has been exposed through at least one sensitometric wedge to produce a halftone or continuous tone test wedge print and (a) comparing the actual distance between areas of different dot value on said test print with a standard distance to determined the deviation between said actual and standard distances, and (b) comparing the location of an actual sensitivity point on said test print with the location of a standard sensitivity point and adding to said developer solution a first replenisher solution $R_A$ in amounts determined by the extent of the deviation found in comparison (a) and a second replenisher solution $R_D$ in amounts determined by the relative location found in comparison (b), said solutions containing the same essential constituents as in said lith-developing solution above in quantities sufficient to meet the following requirements:

1. both replenisher solutions are basic with the pH of $R_D$ being higher than the pH of $R_A$,
2. the halide ion concentration of $R_D$ is lower than the halide concentration of $R_A$,
3. the hydroquinone concentration of $R_D$ is different from the hydroquinone concentration of $R_A$,
4. the free sulphite ion concentration of $R_D$ is lower than the free sulphite ion concentration of $R_A$; the differences mentioned under (3) and (4) being such that the ratio by weight of the hydroquinone to free sulphite ions in the replenisher $R_D$ is different from the corresponding ratio by weight in replenisher $R_A$.

2. A process according to claim 1, wherein two replenisher solutions are used, one being composed of a mixture of said $R_D$ and $R_A$ wherein the amount of $R_A$ in said mixture in the current work load conditions is still insufficient for complete compensation of the developer exhaustion resulting from aerial oxidation and as second replenisher minor amounts of separately stored $R_A$ are introduced serving for the balance in the compensation of exhaustion by oxidation.

3. A process according to claim 1, wherein the replenisher solution $R_A$ is used in two parts, one part $R_{A1}$ having a larger amount of sulphite ions and mainly compensating for the loss of sulphite ions and the other part $R_{A2}$ having a larger content of developing agent than the $R_A$ replenisher and mainly compensating for the loss of developing compound(s).

4. A process according to claim 2, wherein the mixture of $R_A$ and $R_D$ is used in two parts, one part containing with respect to the other part a larger amount of sulphite ions and the other part containing a larger amount of developing compound.

5. A process according to claim 1, wherein the developer already from the very beginning of the automatic development processing contains reaction products that are formed during lith-development of the photographic materials and/or contact with oxygen of the air.

6. A process according to claim 5, wherein one of said reaction products is hydroquinone sulphonate.

7. A process according to claim 6, wherein the replenisher $R_D$ contains hydroquinone sulphonate.

8. A process according to claim 1, wherein the sensitivity point is determined on the continuous tone wedge print at an optical density between 0.3 and 3.0.

9. A process according to claim 1, wherein the sensitivity point is determined on the halftone wedge print between 10% and 95% dot value.

10. A process according to claim 1, wherein integrated density points $D_1$ and $D_2$ corresponding with 10% and 95% dot area respectively are determined on the halftone wedge print and the distance between said points is compared with a reference distance.

11. A process according to claim 1, wherein after one or a plurality of said checks have been carried out and a shift of the sensitivity point to the lower sensitivity values with respect to the sensitivity reference point has been observed either an amount of $R_D$ is added to partially replace the developer, or the rate of partial replacement of the developer by replenisher $R_D$ is increased.

12. A process according to claim 1, wherein after one or a plurality of said checks have been carried out and a shift of the sensitivity point to the higher sensitivity values with respect to the sensitivity reference point has been observed the rate of partial replacement of the developer by replenisher $R_D$ is diminished and/or silver halide material to be developed is put through the developer without replenishment with $R_D$.

13. A process according to claim 1, wherein after one or a plurality of said checks have been carried out and a decrease of said distance between said area of different dot value compared with the reference distance has been detected, either an amount of $R_A$ is used to replace developer or the rate of replacing developer by $R_A$ is increased.

14. A process according to claim 1, wherein after at least one of said checks have been carried out and an increase of said distance between areas of different dot value as compared with the reference distance has been detected, the rate of replacing developer by $R_A$ is diminished.

15. A process according to claim 1, wherein $R_D$ is introduced in the developer to substitute a part of it at a rate controlled by an estimated amount of silver halide to be developed and the detected results of a plurality of said checks, wherein the tendency of a shift of the sensitivity point to the lower sensitivity values is counteracted by an increase of the rate of replacing developer by $R_D$, and the tendency of a shift of the sensitivity point to the higher sensitivity values is counteracted by a decrease of the rate of replacing developer by $R_D$.

16. A process according to claim 1, wherein $R_A$ is introduced in the developer to substitute a part of it at a rate controlled by time, and a tendency of enlargement of the integrated density range detected by a plurality of said checks is counteracted by decreasing the rate of replacing developer by $R_A$.

17. A process according to claim 1, wherein $R_A$ is introduced in the developer to substitute a part of it at a rate controlled by time, and a tendency of reduction of the integrated density range detected by a plurality of said checks is counteracted by increasing the rate of replacing developer by $R_A$.

* * * * *

UNITED STATES PATENT OFFICE

CERTIFICATE OF CORRECTION

Patent No. 4,081,280 Dated March 28, 1978

Inventor(s) Hans Josephus Corluy et al

It is certified that error appears in the above-identified patent and that said Letters Patent are hereby corrected as shown below:

In the Claims:

Claim 1, column 8, line 25, "determined" should read -- determine --.

Claims 11, 12 and 13, line 1 of each, -- at least -- should be inserted after "after"; and line 2 of each, "or a plurality of" should be deleted.

Signed and Sealed this

Eighth Day of August 1978

[SEAL]

Attest:

RUTH C. MASON
Attesting Officer

DONALD W. BANNER
Commissioner of Patents and Trademarks